US008146893B2

(12) United States Patent
Zapalski

(10) Patent No.: US 8,146,893 B2
(45) Date of Patent: Apr. 3, 2012

(54) APPARATUS AND METHOD FOR GENERATING AND TRACING VORTICES

(76) Inventor: Timothy Allen Zapalski, Santa Rosa, CA (US)

( * ) Notice: Subject to any disclaimer, the term of this patent is extended or adjusted under 35 U.S.C. 154(b) by 684 days.

(21) Appl. No.: 12/313,422

(22) Filed: Nov. 19, 2008

(65) Prior Publication Data

US 2009/0223305 A1 Sep. 10, 2009

Related U.S. Application Data

(60) Provisional application No. 61/003,784, filed on Nov. 19, 2007.

(51) Int. Cl.
*B01F 3/04* (2006.01)

(52) U.S. Cl. ..... 261/79.2; 261/91

(58) Field of Classification Search ..... 261/79.2, 261/83, 84, 91

See application file for complete search history.

(56) References Cited

U.S. PATENT DOCUMENTS 3,360,460 A * 12/1967 Weston ..... 210/758
4,741,869 A * 5/1988 Hove ..... 261/24
5,322,646 A * 6/1994 Wright et al. ..... 261/79.2
5,549,854 A * 8/1996 Hulthom et al. ..... 261/87
6,007,237 A * 12/1999 Latto ..... 366/315
6,616,094 B2 * 9/2003 Illingworth ..... 244/12.1
6,689,225 B2 * 2/2004 Illingworth ..... 134/21
6,997,444 B2 * 2/2006 Weetman et al. ..... 261/91
7,350,773 B2 * 4/2008 French et al. ..... 261/79.2
2004/0244988 A1 * 12/2004 Preston ..... 166/369

* cited by examiner

*Primary Examiner* — Charles Bushey
(74) *Attorney, Agent, or Firm* — D. Benjamin Borson; Borson Law Group, PC

(57) ABSTRACT

Apparatus and methods for generating and tracing vortices include an actuator that is moved through a fluid is such a fashion as to produce a difference in pressure between two faces, so that the fluid is drawn from an area of higher pressure into an area of lower pressure around an edge of the actuator, thereby producing a vortex. A vortex generator produces vortices in air or other fluid, without an external chamber being required. The rotational velocity of such a vortex is greater than the rotational velocity of the actuator. The shape, size, and strength of the vortices can be controlled by varying one or more of the size, shape, and speed of the apparatus' actuator including its leading and trailing edges, height of the actuator above the surface, and the angles between the plane of the actuator and the motion through the fluid. A vortex may be visualized easily using a tracing material which is introduced into the vortex. Vortices so produced can be used as amusements or for research into the ways in which vortices interact with structures, including airfoils, vehicles, buildings or other structures.

11 Claims, 9 Drawing Sheets

500

501

502

APPARATUS AND METHOD FOR GENERATING AND TRACING VORTICES

CLAIM OF PRIORITY

This application claims priority to U.S. Provisional Application No. 61/003,784, filed Nov. 19, 2007, entitled "Apparatus and Method for Generating and Tracing Vortices," Timothy Allen Zapalski, inventor. This application is expressly incorporated fully herein by reference.

FIELD OF THE INVENTION

This invention relates to an apparatus and method for generating and tracing vortices. More specifically, this invention relates to a mechanical device comprising a base and an actuator for generating and tracing vortices. This invention also relates to a method for generating and tracing vortices comprising moving an actuator over a base.

SUMMARY OF THE INVENTION

Aspects of this invention include apparatus and methods for generating vortices of various shapes and behaviors in air, without a chamber being required, and with the ability to trace the vortex. One aspect of the invention is an actuator, which generally, is a piece of material that is moved through the fluid in which the vortex is to be generated. As the actuator moves through the fluid, a pressure differential is created that results in a flow of fluid around an edge of the actuator from an area of high pressure to an area of low pressure. Because the flow of fluid moves in a curved path around an edge, a vortex can be formed. The shape, size, and strength of the vortices can be controlled by a user of the invention by varying one or more of the size, shape, orientation and speed of an actuator of the apparatus.

An actuator is generally attached to a rod, which is attached to an axle, which is driven by a motor or similar device. An actuator can be attached to the rod using a coupling that can be adjusted in three (3) dimensions, to permit the user to select one or more of the angles between the actuator and the fluid through which the actuator moves.

In certain aspects, the apparatus optionally comprises a base with a perforated top and an actuator positioned over the perforated top. In other embodiments, the apparatus comprises a base and an actuator is suspended over the perforated top. According to other embodiments, the apparatus further comprises a mover for moving the actuator over the perforated top in a plane that is substantially parallel to the perforated top.

According to further embodiments of the invention, the actuator can move in a substantially circular pattern above the perforated plate. According to other embodiments of the invention, the mover for moving the actuator can be a motor. According to still further embodiments, the motor can be connected to the actuator by a rod or pole. According to yet other embodiments, the actuator can be operably connected to a rod, which in turn is operably connected to an axial rod, which in turn is operably connected to a motor or other mover. According to still other embodiments, the actuator can be connected to the motor without a rod or pole being present.

As the actuator moves above the perforated top according to embodiments of the invention, a vortex is generated by a pressure difference, producing a vortex, which can trail the actuator.

According to yet other embodiments of the invention, as the vortex forms above the perforated top, the vortex draws a tracing material into the vortex through the perforated top, rendering the vortex more easily visible to the naked eye. According to still further embodiments of the invention, as the vortex forms above the perforated top, the vortex draws a tracing material into the vortex from beneath the perforated top, rendering the vortex more easily detectable by instrumentation.

BRIEF DESCRIPTION OF THE FIGURES

This invention is described with respect to several embodiments thereof. Other features can be found with reference to the Figures, in which.

DETAILED DESCRIPTION

Figure 1:
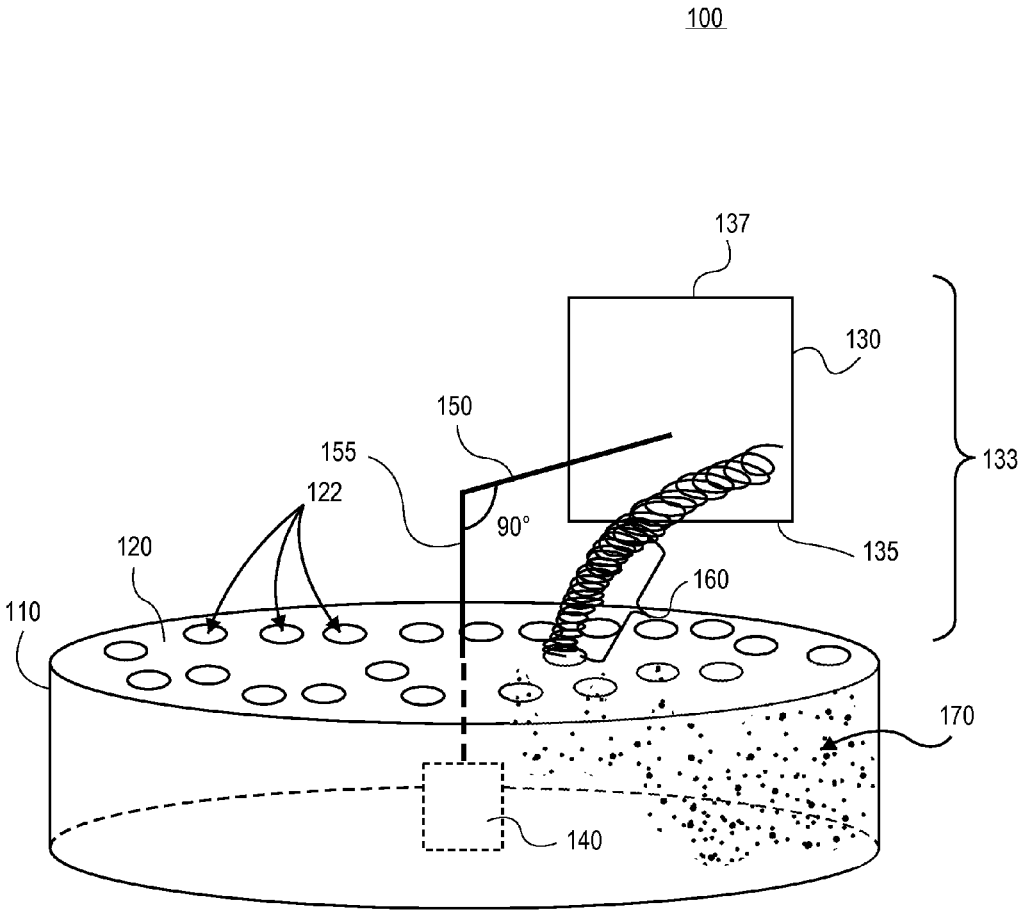
FIG. 1 depicts a oblique view of an embodiment of the invention showing an actuator, connecting apparatus, a base with a motor and a tracing material.

According certain embodiments of the invention, the actuator can be moved in a plane substantially parallel to a base. According to yet other embodiments, a vortex trails just behind and inside the vertical edge of the actuator, at the outside of a circle in the plane parallel to the base.

Vortex generators of this invention do not require any enclosure. Prior art vortex generators typically have an enclosure to direct the flow of fluid. Rotation is typically produced by one or more "paddles" that rotate about an axis. Such rotation directly forces the fluid in a rotary motion, and the speed of rotation of the paddles produces a vortex that rotates at the same rotational velocity as the paddles. Unlike these prior art vortex generators, generators of this invention can produce vortices having rotational velocities substantially greater than the rotational velocity of the actuator.

According to certain embodiments of the invention, the actuator can move in a substantially circular pattern. According to other embodiments, the actuator can move in a substantially linear direction. According to yet other embodiments, the actuator can move in a substantially oval pattern.

According to yet further embodiments, a mover can be a device traversing a track. According to still other embodiments of the invention, the track can be oval-shaped. According to yet other embodiments, a perforated top can be shaped so that the actuator is suspended above the perforated top as it is moved in the oval path.

According to yet other embodiments, the apparatus may comprise more than one actuator, each of which is capable of generating a vortex.

Usefulness of Artificially Generated Vortices

Artificially generated vortices have many uses. For example, vortices are esthetically pleasing and interesting and thus, vortices may be generated to amuse and entertain. Artificially generated vortices can also important in science to study the effect of vortices such as tornadoes on model buildings, automobiles, airplanes, boats and other structures and transportation devices. Artificial vortices can also be important in the field of meteorology to aid in the study of tornado behavior leading to increased safety for the general public. Artificially generated vortices can be used for a host of commercial applications such as, for example, heating, ventilating, and air conditioning (HVAC) applications, stopping oil tank leaks, or suppressing fires.

New Design for Vortex Generators

Aspects of this invention include apparatus and methods for generating vortices of various shapes and behaviors in a fluid such as air, without a chamber being required, and with the ability to easily visualize the vortex. It can be appreciated that vortex generators of this invention can also produce vortices in other fluids, including other gases or liquids, including water. The shape, size, and strength of the vortices can be controlled by a user of the invention by varying one or more of the size, shape, and speed of an actuator of the apparatus.

Actuators

An actuator is used to create a pressure difference. As an actuator moves through a fluid, a pressure difference is produced with higher pressure at the front of the actuator and a lower pressure behind the moving actuator. This pressure difference is relieved by a tendency of the fluid to move from the area of higher pressure to an area of lower pressure behind the actuator. Because the edge of the actuator prevents direct motion of the air from in front of the moving actuator to behind the actuator, the fluid is forced to move around the edge of the actuator. It is this movement around the edge of an actuator that produces a rotary motion of the fluid. This rotary motion is what produces a vortex. In some cases, the actuator motion can be very rapid and can produce an area of low pressure behind the actuator. Because of the law of conservation of angular momentum, it can be appreciated that once produced, a vortex may no longer require the continued presence of an actuator, and a vortex can be "shed" from the actuator.

The shapes and configurations of actuators affect production of vortices. Thus, in aspects of this invention, different shaped actuators can be used. In some embodiments, a substantially square or rectangular actuator can be used. According to yet other embodiments, a diamond-shaped actuator can be used. According to still further embodiments, a parallelogram-shaped actuator can be used. According to other embodiments, a trapezoidal, semicircular-shaped actuator can be used. It can be readily appreciated that other shapes of actuators can be used.

In addition to the general shape of an actuator, an actuator may have different leading and trailing edges. It can be appreciated that a long trailing edge can produce a vortex having a relatively large mass of rotating fluid, whereas an actuator having a short trailing edge typically produces vortices having a relatively lower mass of rotating fluid.

According to certain embodiments, an actuator can be fixed in place at a height above a perforated top or other surface in a plane that is substantially perpendicular to the surface. The actuator is connected to a rod, which in turn is connected to an axial rod, which in turn is connected to a mover. In some embodiments, a mover is part of a base. Alternatively, in other embodiments, an actuator is suspended over the ground, a tabletop, or another surface. In embodiments in which the mover is a rotating motor, an actuator has an inner portion and an outer portion, relative to the axis of rotation.

According to an embodiment, the actuator is a substantially square, flat paddle with lateral dimensions approximating the height at which the actuator is positioned over the perforated top. A difference in fluid pressure is created by the rotation of the actuator that is asymmetrical with respect to the outer and inner portions of the actuator.

As the actuator moves in a substantially circular pattern in a plane above and substantially parallel to the perforated top, one or more vortices are generated in an area behind the actuator. The vortex trails behind and inside the vertical edge of the actuator.

Orientation of an Actuator Relative to Motion Through a Fluid

It can be appreciated that an actuator can be placed in a 3-dimensional space relative to a fluid. Thus, there can be 3 angles that can be controlled. An actuator can be attached to an axle via a rod. In these embodiments, the rod can be moved in a circular pattern. There is an angle between the plane of an actuator (in which the actuator is "flat"), and the rod to which the actuator is attached. If the plane of the actuator is co-linear with the rod, an angle is "0" when viewed from the top. Accordingly, the "angle of attack" is 90 degrees. "Angle of attack" is used herein with its usual aeronautical meaning. Thus, in a situation in which the angle of attack is 0, the "leading" edge and the "trailing" edge are in the same plane as the direction of motion. Thus, there is a "top" and a "bottom" side of the actuator. In this configuration, the actuator can move through the fluid with a minimum of pressure difference. When the angle of attack is increased above 0 (i.e., the leading edge of the actuator is elevated above the trailing edge) and the actuator is moved through the fluid, the fluid will be urged in a direction "downwards." In certain embodiments, this angle can be set to be greater than or less than zero. It can be appreciated that as the angle of attack is increased, there will be a point at which the flow of fluid ceases to be laminar and the actuator "stalls." As used herein, the term "stall" has its usual meaning in aeronautical arts. In a stalled configuration, an actuator can create large vortices.

Second, as the actuator "sweeps" through the fluid, there is an "inside" edge and an "outside" edge. In certain embodiments, the edges of a rectangular actuator can be perpendicular to the rod (or "normal" to a surface below the actuator). In other embodiments, the inside or outside edge can be set an angle that is not normal, but rather, can be either "tiled in" or "tilted out" relative to the vertical. Such embodiments can be apparent from views from the side.

Third, for actuators that have a generally flat shape, an angle of the actuator can be offset from the vertical in a third dimension. Thus, when viewed from the "end", a top part of an actuator can be either forward of or behind of a middle portion of the actuator.

Thus, according to certain of these embodiments in which there is an underlying surface, the actuator can be tilted relative to the surface. According to other embodiments, the actuator can be parallel to the surface. Variation of the distance of the inner portion from the surface will affect the shape, size, and strength of the vortex. A number of designs for the actuator are possible, including those described in examples below. The set of values and designs chosen for the actuator, the angle of the actuator relative to the rotating pole, and the height of the actuator above the surface can affect the shape, size, and strength of generated vortex.

Base

According to certain embodiments, the apparatus optionally comprises a base. A base can focus the lower end of a vortex. By virtue of a vortex having an area of low pressure (e.g., the "eye" of the vortex), the lower end of the vortex will tend to become "attached" to the base. Such attachment tends to decrease the loss of low pressure and therefore tends to maintain the integrity of the vortex. A base can have a perforated top surface, through which a tracer material can pass. However, it can be appreciated that vortices can be formed and can persist for a period of time without being "attached" to a base.

Mover

According to examples described below, according to certain embodiments, a mover for moving the actuator is located within the base and may be a motor. The mover is operably connected to the actuator by a connecting rod. The mover moves the actuator over a perforated top in a plane that is substantially parallel to the perforated top. According to other examples described below, the mover is a train that moves the actuator in a substantially oval or other desired configuration. According to this embodiment, the mover is a train that progresses around a track. According to still other examples described below, a power source comprises a motor or other mover. The motor or other mover is operably connected to an axial rod, which is operably connected to a connecting rod, which in turn is operably connected to the actuator. The mover impels the axial rod to rotate about an axis of rotation. The axial rod may rotate at a constant speed, or may rotate at a variable speed.

Materials and Construction

Components of the apparatus can be constructed, for example, of one or more of metal, of wood, of plastic, of glass, metal and/or of any other convenient material. Examples of metals that may be suitable include iron, steel, aluminum, and tin.

Tracing Vortices

According to other embodiments, a vortex produced by a generator of this invention can be visualized using a tracer. A tracing material can be smoke, fog, powder, heavy gases, or any other substance light enough to be drawn into a vortex. The tracing material typically has a density greater than the density of the fluid in which the vortex is being generated.

The tracing material can be placed beneath the perforated top or other surface before the apparatus is started or can be replenished during operation. The vortex draws a tracing material through the perforated top, rendering the vortex easier to detect for the human eye or instrumentation. In some embodiments, a tracing material can be particles of condensed water vapor. In embodiments in which ambient air is the fluid, the air typically contains some amount of dissolved water (as vapor). It can be appreciated that if the temperature of such air is reduced, a condensation temperature can be reached, and the water vapor condenses to produce a particulate, or "fog." This fog can then be drawn through perforations in the base and drawn into the vortex, thus rendering the vortex visible.

EXAMPLES

The following examples are intended to illustrate embodiments of the invention. It can be appreciated that the examples are show for purposes of illustration only, and that variations can be easily produced by persons of ordinary skill. All such embodiments are considered part of this invention.

Example 1

Actuator Oriented Perpendicular to Surface

FIG. 1 depicts an oblique view of a vortex generator 100 according to an embodiment of the invention. Apparatus 100 includes base 110 with a substantially planar perforated top 120 with perforations 122. Actuator 130 is positioned over perforated top 120. Actuator 130 is fixed in place at height 133 above perforated top 120 in a plane that is substantially perpendicular to perforated top 120.

Actuator 130 has an inner portion 135 and an outer portion 137. Actuator 130 is a substantially square, flat paddle with lateral dimensions approximating the height at which actuator 130 is positioned over perforated top 120.

A rotary motor 140 is located within base 110. Motor 140 is operably connected to actuator 130 by axle 155 and connecting rod 150. Motor 140 moves actuator 130 in a circular motion over perforated top 120 in a plane that is substantially parallel to perforated top 120. Axial rod 155 may be rotated at a constant speed or may rotated at a variable speed. As actuator 130 moves in a circular pattern in a plane above and parallel to perforated top 120, vortex 160 is generated (swirled line). Vortex 160 trails just behind actuator 130. Within base 110, tracing material 170 is depicted, here shows as a series of dots for illustration. As vortex 160 approaches perforated top 120, tracing material 170 is drawn up through perforations 122 and into vortex 160, increasing its visibility.

Example 2

Actuator Moving in Oval Pattern

Figure 2:
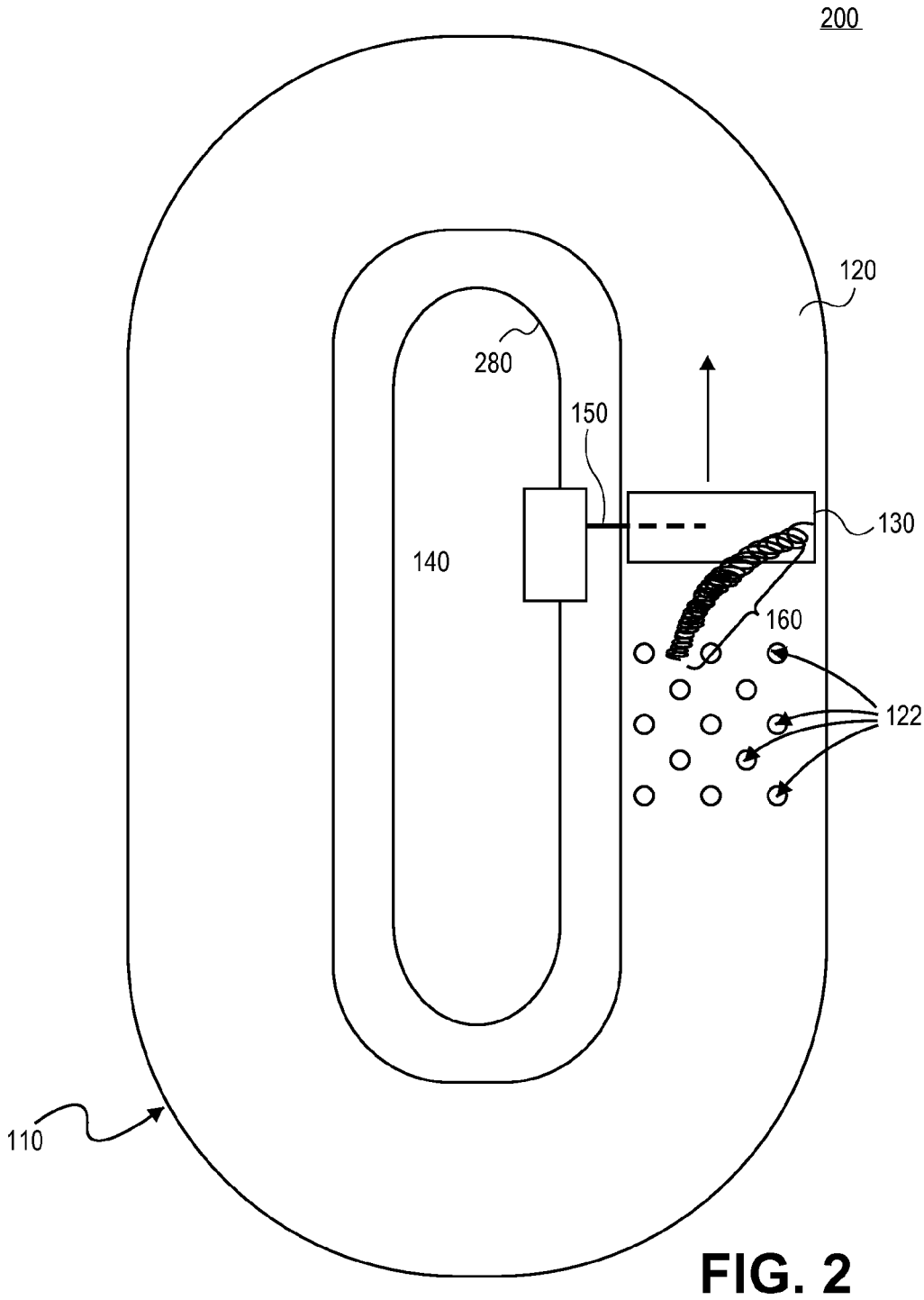
FIG. 2 depicts a top view of an embodiment of the invention wherein an actuator moves in an oval pattern.

FIG. 2 depicts a top view of an alternative embodiment 200 of this invention. Vortex 160 (swirled line) is produced by actuator 130 moving in an oval pattern. Base 110 has track 280 upon which mover 140 is positioned. Connecting rod 150 is shown attached to mover 140 and actuator 130. A portion of rod 150 is hidden from view (dashed line), In this view, actuator 130 is shown moving in a linear direction (arrow). It can be appreciated that as actuator 130 reaches the curve in track 280, that actuator 130 will then move in a counterclockwise direction. Base 110 has perforated top 120 with perforations 122 therethrough. Tracing material (not shown) is underneath perforated top 120, and when vortex 160 passes over perforations 122, tracing material is drawn up through perforations 122, is drawn into vortex 160, thereby increasing visibility of vortex 160.

Example 3

Actuator Suspended Over Base

Figure 3:
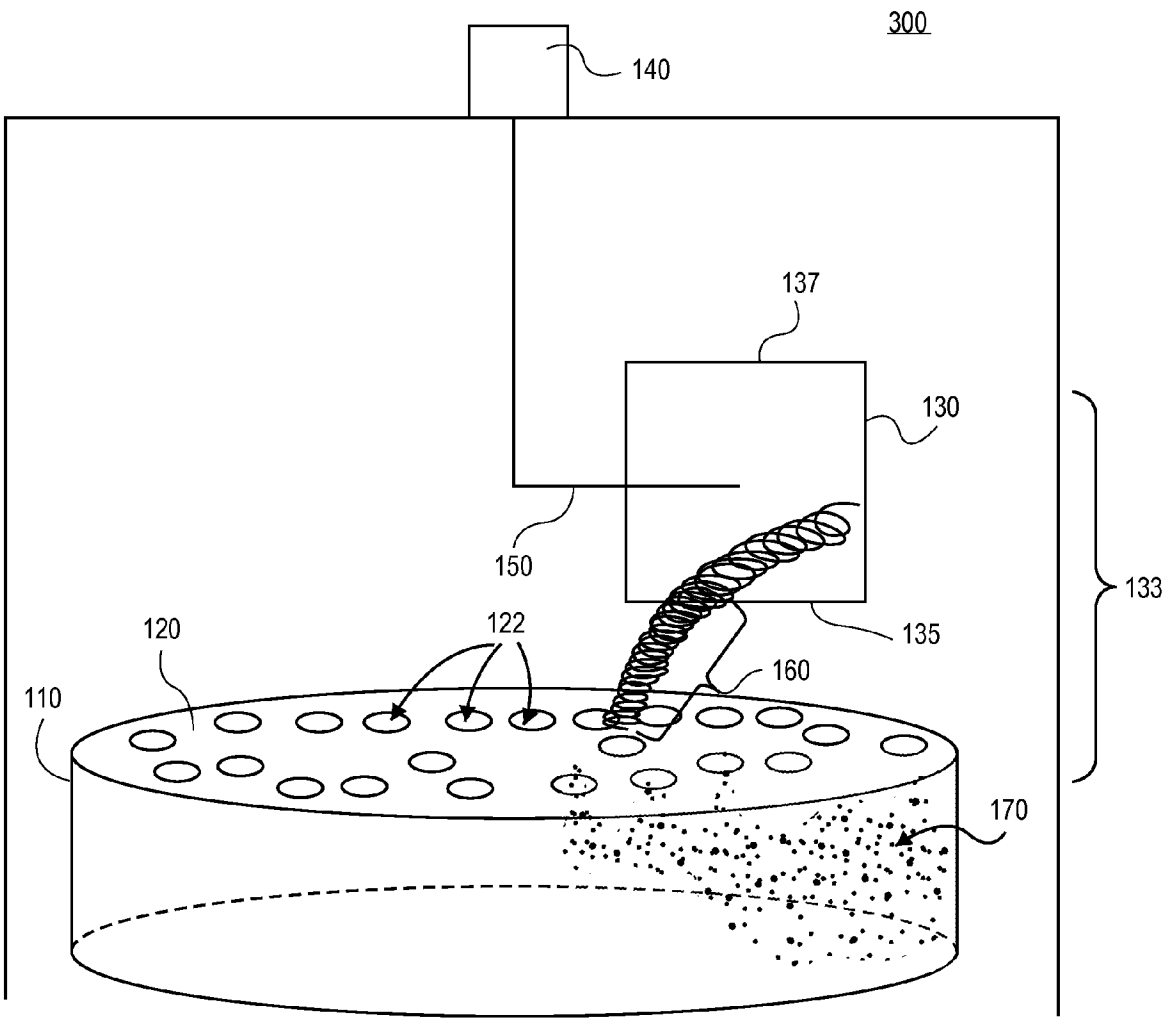
FIG. 3 depicts a side view of an embodiment of the invention wherein an actuator is suspended above a base.

FIG. 3 depicts a side view of embodiment 300 of this invention. Base 110 has perforated top 120 with perforations 122 therethrough. Actuator 130 is suspended over perforated top 120 at height 133. Rotary motor 140 is shown attached to axle 150, which is attached to connecting rod 155, which is attached to actuator 130.

Actuator 130 has top edge 135, bottom edge 137, outer edge 136 and inner edge 138. Actuator 130 is a substantially square, flat paddle with lateral dimensions approximating the height at which actuator 130 is positioned over perforated top 120.

Tracer material 170 is shown as a series of dots within base 110. As actuator 130 is rotated counterclockwise as viewed from above, an area of decreased pressure is formed behind actuator 130. As vortex 160 approaches perforated top 120, tracer 170 is drawn up through perforations 122, and into vortex 160, thereby increasing visibility of vortex 160.

Example 4

Actuator Oriented at Acute Angle

Figure 4:
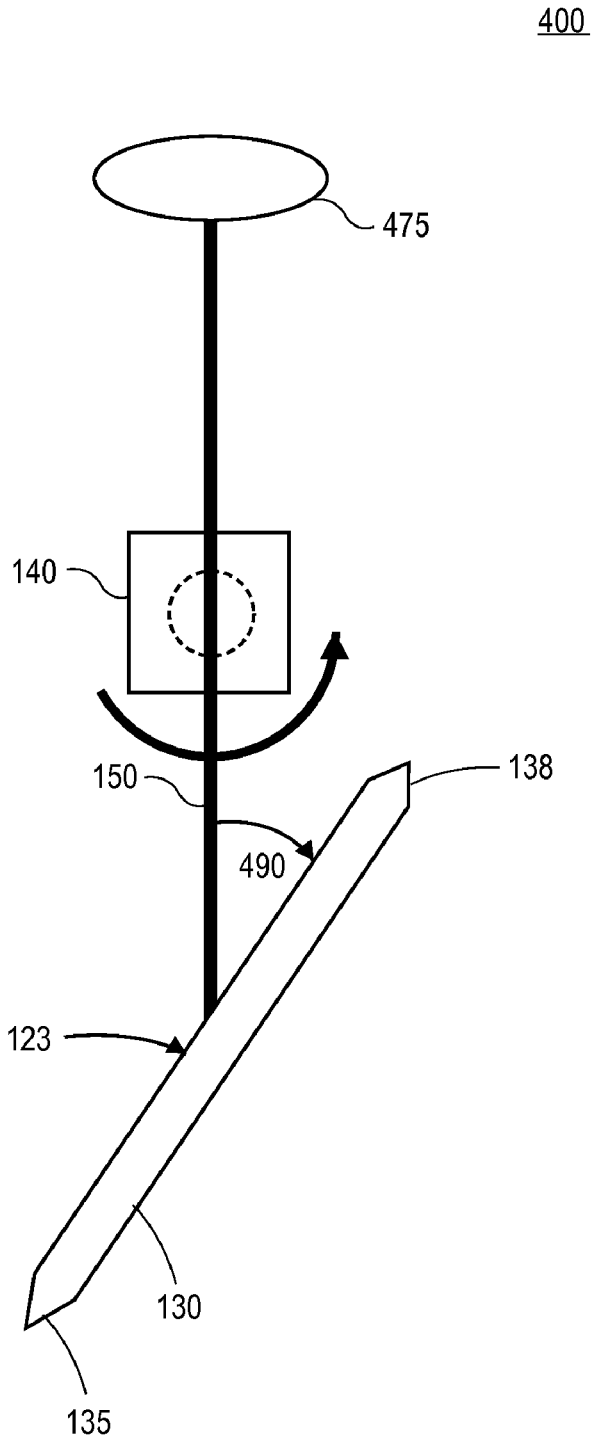
FIG. 4 depicts a top view of an embodiment of the invention wherein the actuator is an angle relative to the motion of the actuator through a fluid.

FIG. 4 depicts a top view of embodiment 400 of the invention. Actuator 130 is shown having leading edge 138 and trailing edge 300. Actuator 130 is attached to connecting rod 150, by connector 123. Connecting rod 150 is attached to axle (not shown in this view), which is attached to rotary motor 140. Actuator 130 is shown as a flat for purposes of illustrating angle 490 relative to connecting rod 150.

It can be appreciated that angle 490 can be adjusted by altering the orientation of connector 123.

Example 5

Alternative Actuator Designs

Figure 5A:
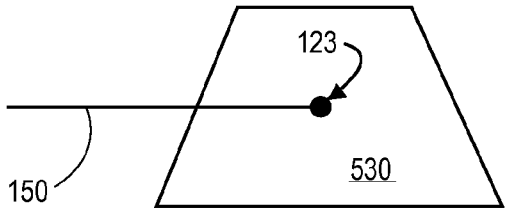
FIGS. 5*a*-5*c* depict side views of alternative shapes of actuators of this invention.
Figure 5B:
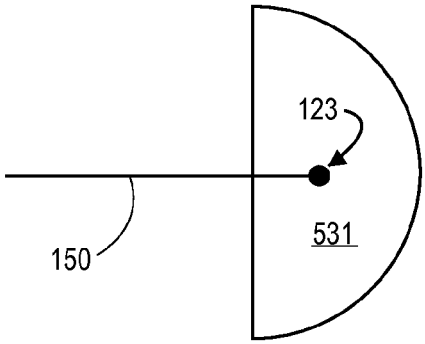
Figure 5C:
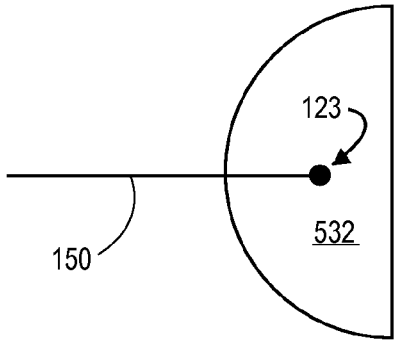

FIGS. 5*a*, 5*b* and 5*c* alternative designs for actuators 530, 531 and 532, respectively. Actuators 530, 531 and 532 are shown attached to connecting rod 150 by way of connectors 123. It can be appreciated that orientation of actuators 530, 531 and 532 with respect to connecting rod 150 can be adjusted as desired.

Example 6

Alternative Leading and Trailing Edge Designs

Figure 6A:
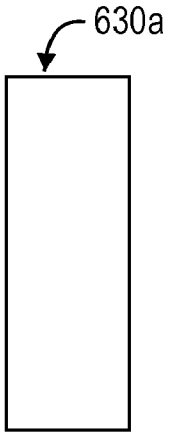
FIGS. 6*a*-6*f* depict end views of alternative designs for leading and/or trailing edges of actuators used in embodiments of this invention.
Figure 6B:
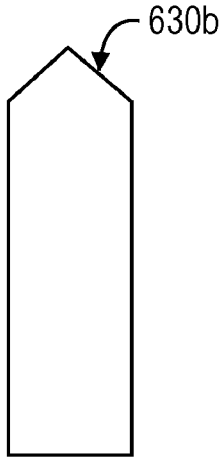
Figure 6C:
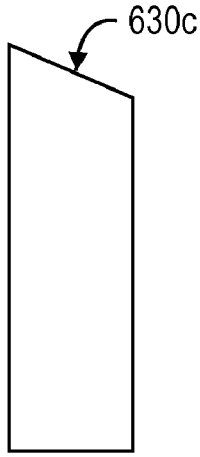
Figure 6D:
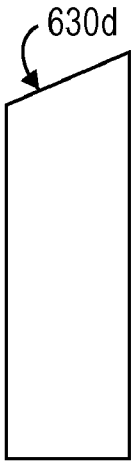
Figure 6E:
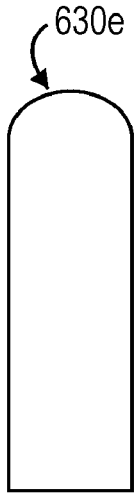
Figure 6F:
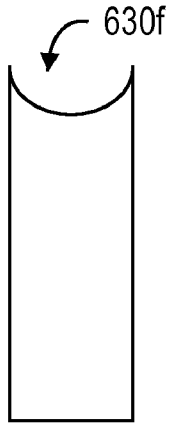

FIGS. 6*a*-6*f* depict several alternatives for designs of leading edge 138 and trailing edge 135 as shown in FIG. 4. FIG. 6*a* depicts rectangular edge 630*a*. FIG. 6*b* depicts triangular edge 630*b*. FIG. 6*c* depicts beveled edge 630*c*. FIG. 6*d* depicts beveled edge 630*d*, like that shown in FIG. 6*c* except that the bevel is in the opposite direction. FIG. 6*e* depicts rounded edge 630*e* and FIG. 6*f* depicts concave edge 630*f*. It can be appreciated that the above edge designs can be used for the leading edge, the trailing edge or both leading and trailing edges. It can also be appreciated that one can select one design for a leading edge and another design for a trailing edge.

Example 7

Alternative Orientations of Actuators (Side Views)

Figure 7A:
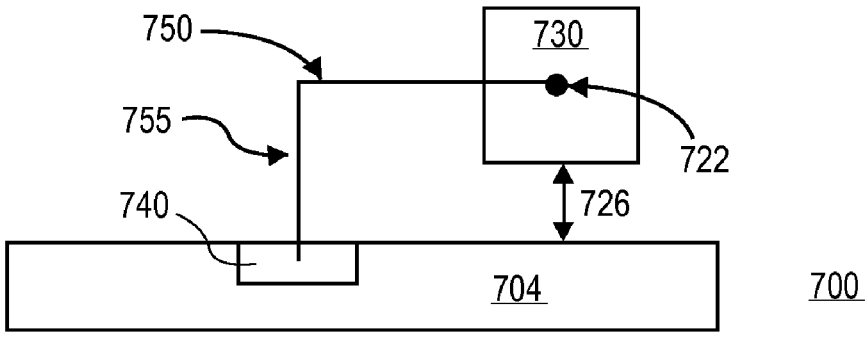
FIGS. 7*a*-7*c* depict side views of embodiments of this invention in which the position and configuration of the actuator is shown.
Figure 7B:
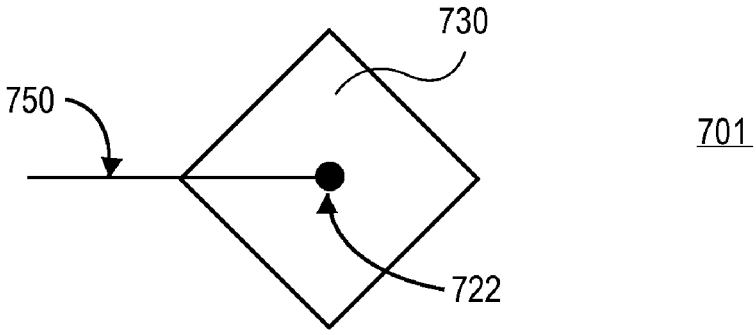
Figure 7C:
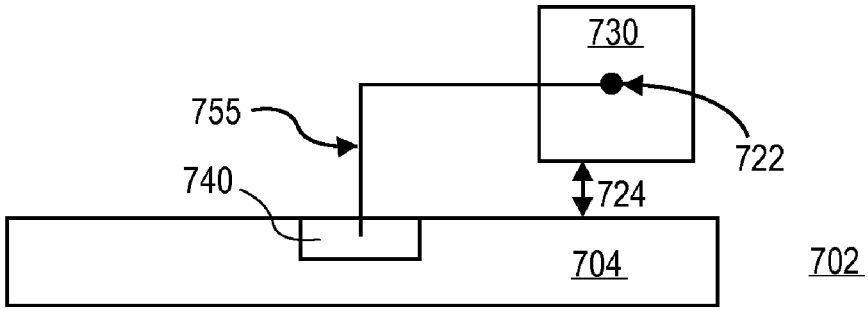

FIGS. 7*a*-7*c* depict side views of alternative designs 700, 701 and 702 for vortex generators of this invention. FIG. 7*a* depicts embodiment 700 having base 704, rotary motor 740 attached to axle 755, which is attached to connecting rod 755. Actuator 730 is shown attached to connecting rod 750 by 3-way connector 722. Actuator 730 is shown above base 704 at distance 726.

FIG. 7*b* depicts an alternative orientation of actuator 730 relative to connecting rod 750. Compared to the embodiment 700 shown in FIG. 7*a*, actuator has been rotated about connector 722.

FIG. 7*c* depicts an alternative 703, similar to that shown in FIG. 7*a* except that distance 727 is shown smaller than the corresponding distance (726) shown in FIG. 7*a*.

Example 8

Alternative Orientations of Actuators (Top Views)

Figure 8A:
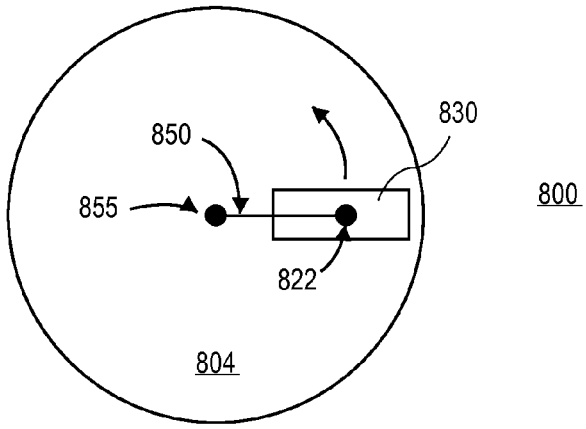
FIGS. 8*a*-8*c* depict top views of alternative embodiments of this invention in which the actuator is shown in different orientations relative to the movement of the actuator through a fluid in which a vortex is generated.
Figure 8B:
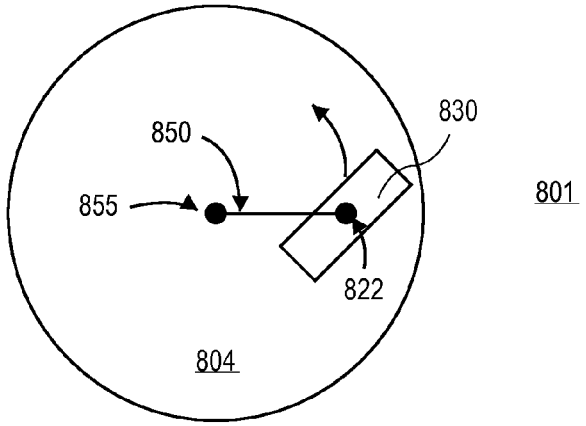
Figure 8C:
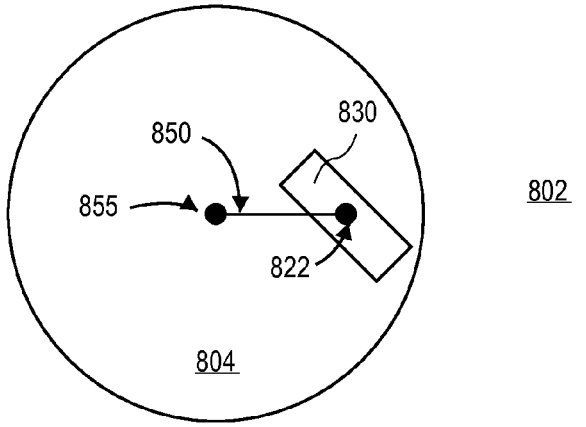

FIGS. 8*a*-8*c* depict top views of alternative embodiments 800, 801 and 802 of this invention. FIG. 8*a* depicts a top view of embodiment 800 having base 804, and showing axle 855 attached to connecting rod 850, which is attached to actuator 830 via connector 822. The angle between the plane of actuator 830 and connecting rod 850 is shown as 0. Rotary motor (not shown) can rotate axle 855 to move actuator 830 in a clockwise motion (arrow).

FIG. 8*b* depicts a top view of embodiment 801 similar to that shown in FIG. 8*a* except that actuator 830 is attached to connecting rod 850 using connector 822 so that the outer edge of actuator 830 is shown as a leading edge.

FIG. 8*c* depicts a top view of embodiment 802, similar to those shown in FIG. 8*a* and 8*b*, except that actuator 830 is attached to connecting rod using connector 822 so that the inner edge of actuator 830 is shown as a leading edge.

Example 9

Alternative Orientations of Actuators (End Views)

Figure 9A:
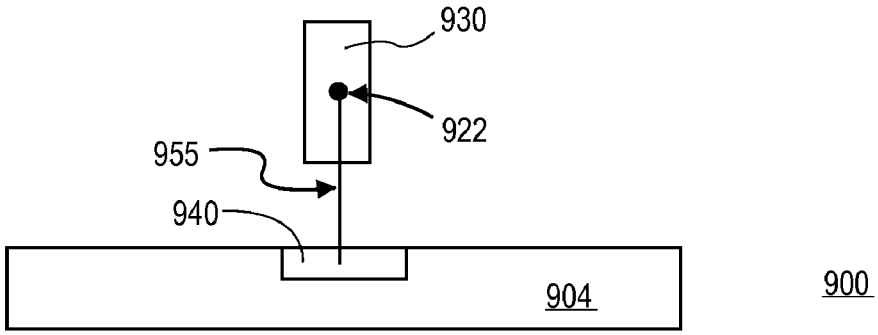
FIGS. 9*a*-9*c* depict end views of alternative embodiments of this invention in which the actuator is shown in different orientations relative to the movement of the actuator through a fluid in which a vortex is generated.
Figure 9B:
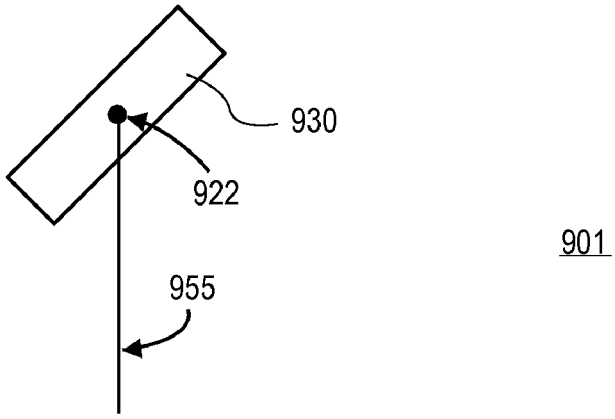
Figure 9C:
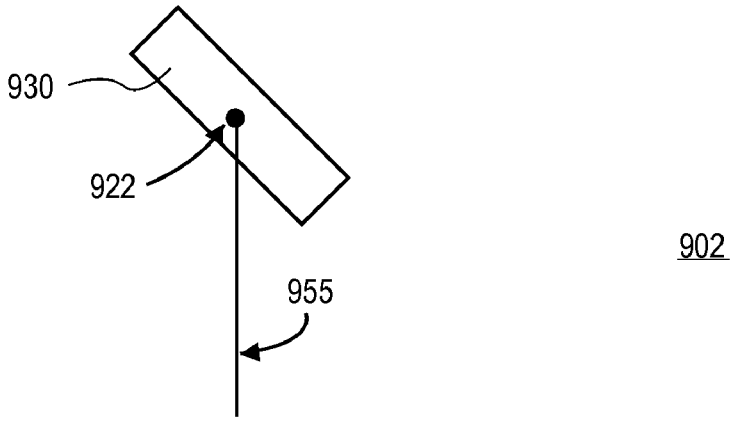

FIGS. 9*a*-9*c* depict end views of embodiments 900, 901 and 902 of this invention, respectively. FIG. 9*a* depicts embodiment 900 having base 904, rotary motor 940 and axle 955. Actuator 930 is connected to connecting rod (not shown) using connector 922. As shown in FIG. 9*a*, actuator 930 is perpendicular to the upper surface of base 904.

FIG. 9*b* depicts an alternative embodiment 901 of this invention, in which actuator 930 is connected to connecting rod (now shown) by connector 922, so that there is an angle between actuator 930 and axle 955.

FIG. 9*c* depicts an alternative embodiment 902 of this invention in which actuator 930 is connected to connecting rod (not shown) by connector 922, so that there is an angle between actuator 930 and axle 955, like in FIG. 9*b* except that the angle is in the opposite direction.

I claim:

1. A vortex generator comprising:

a base having a perforated top and walls, said top and walls defining a space within said base, and said space having a suspension of particles therein, said particles being sufficiently light to be drawn through said perforations in response to a flow of fluid from within said base through said perforations;

an actuator positioned over said base in a fluid;

said actuator having a front, a leading edge, a back, and a trailing edge;

a motor operably linked to said actuator to produce a motion of said actuator in a closed pattern relative to said base; and wherein motion of said actuator produces a difference in pressure between said front and said back, and wherein said difference in pressure produces a vortex in said fluid.

2. The vortex generator of claim 1, wherein said actuator is operably linked to said base.

3. The vortex generator of claim 1, wherein said actuator has a shape selected from the group consisting of circular, semicircular, trapezoidal and rectangular.

4. The vortex generator of claim 1 wherein said actuator has a trailing edge selected from the shape selected from the group consisting of square, triangular, convex, concave, and beveled.

5. The vortex generator of claim 1, wherein said particles are solid particles.

6. The vortex generator of claim 1, wherein said particles are condensed water vapor.

7. The vortex generator of claim 6, wherein said water vapor is produced by cooling fluid in said base to below the condensation temperature of water in said fluid.

8. A method for producing a vortex, comprising:

providing a vortex generator of claim 1;

producing motion of said actuator in a closed pattern relative to said base;

wherein said motion produces a vortex having a rotational velocity greater than the rotational velocity of said actuator.

9. The method of claim 8, wherein said motion of said actuator is substantially circular.

10. The device of claim 1, wherein said closed pattern of motion of said actuator is oval.

11. A method for tracing vortices, comprising:

providing a vortex generator of claim 1;

producing motion of said actuator to produce a vortex having a rotational velocity greater than the rotational velocity of said actuator; and wherein said particles in suspension are drawn through said perforations and into said vortex, thereby rendering said vortex visible.

* * * * *